United States Patent [19]

Bezstarosti et al.

[11] 4,111,238

[45] Sep. 5, 1978

[54] APPARATUS FOR CONTROLLING SHED FORMATION IN A TRAVELLING-WAVE LOOM

[75] Inventors: Ladislav Bezstarosti; Antonin Lindental; Jiri Lanta; Jaroslav Cizek, all of Usti nad Orlici, Czechoslovakia

[73] Assignee: Vyzkumny ustav bavlnarsky, Usti nad Orlici, Czechoslovakia

[21] Appl. No.: 729,202

[22] Filed: Oct. 4, 1976

[30] Foreign Application Priority Data

Oct. 3, 1975 [CS] Czechoslovakia ..... 6700/75

[51] Int. Cl.[2] ..... D03D 47/26

[52] U.S. Cl. ..... 139/436

[58] Field of Search ..... 139/11, 13 R, 16, 55, 139/436; 66/9 B, 10, 13

[56] References Cited

U.S. PATENT DOCUMENTS

| | | | |
|---|---|---|---|
| 720,181 | 2/1903 | Salisbury | 139/436 |
| 3,414,021 | 12/1968 | Malchair | 139/13 |
| 3,749,135 | 7/1973 | Linka | 139/436 |

FOREIGN PATENT DOCUMENTS

| | | | |
|---|---|---|---|
| 2,202,470 | 7/1973 | Fed. Rep. of Germany | 139/436 |

*Primary Examiner*—Henry S. Jaudon

[57] ABSTRACT

An improved technique for presetting the adjustment cams that move the heddles of a travelling wave loom between their upper and lower shed-forming positions as described. The succession of control cams or guiding members, which engage actuating butts on the lower ends of the successive heddle members in the weaving region of the loom, are carried by a first endless conveyor; the succession of guiding members includes spaced adjustment portions including a slider element having three superposed cam track junction portions. A control section in the form of a travelling endless program member resembling a second endless conveyor upstream of the weaving region is selectively coupled to a link which engages a roller supported on the slider of each adjustment portion of the succession of guiding members. The link is movable into three positions corresponding to the three positions of adjustment of each slider. Facilities are described for securing each slider in its adjusted position, and for indicating an alarm and/or a loom stopping mechanism if the slider inadvertently moves out of its adjusted position prior to reaching the weaving region.

8 Claims, 14 Drawing Figures

FIG. I

APPARATUS FOR CONTROLLING SHED FORMATION IN A TRAVELLING-WAVE LOOM

BACKGROUND OF THE INVENTION

The invention relates to apparatus for controlling shed formation in a travelling wave loom.

In a known arrangement of this type, a plurality of heddle elements are disposed in parallel, axially spaced relation in at least one heddle holder along a weaving region of the travelling wave loom. Actuating butts at the lower ends of the heddle elements are captured within one of two superposed cam tracks in a succession of cams or guiding members on an adjacent first endless conveyor, such tracks serving to guide the captured heddle element into an upper shed-forming position and a lower shed-forming position, respectively, in accordance with a predetermined program.

At periodic intervals along the succession of guiding members on the first conveyor, adjustment sections are provided for coupling the cam tracks upstream of such adjustment portion in either direct or inverted fashion to the cam tracks downstream of such adjustment portion. Each such adjustment is effective to control the portion of the loom shed during the next portion of the travelling wave cycle.

In such known arrangement, control of the adjustment portion of the succession of guiding members on the first conveyor for the switching of the cam tracks is effected by means of sinkers. Such sinkers are associated with a tiltable element in each adjustment section of the succession of guiding members on the first conveyor, such tiltable section being movable into one of three positions for maintaining the cam track arrangement or for reversing them in one of two opposite senses.

A disadvantage of such facilities is the presence of severe impacts during the movement of the tilting adjustment member, and also during movement of the heddle elements through the tilting member even when no change of cam tracks is to be effected. Such impacts result in rapid wear of the shed-forming portion of the loom, and also constrain such portion to operate at a relatively low speed.

SUMMARY OF THE INVENTION

In the illustrative embodiment, the apparatus has at least two heddle rows arranged one after the other in the weaving region of the loom, the heddles in each row being arranged side-by-side, heddle holders in each heddle row, said holders being movable independently of one another into lower and upper dead center position to form the shed wave, an array of guiding members associated with each heddle row, and means for moving the guiding members in sequence across the loom. Such illustrative embodiment further has a pair of superposed upper and lower guiding track sections provided in each guiding member, the respective upper and lower guiding track sections of all guiding members in each array forming together upper and lower tracks for controlling the strokes of the heddle holders to form a wave shed, the lower guiding track being adapted to guide the heddle holders into the lower dead center position and the upper guiding track being adapted to guide them into the upper dead center position.

In each array of guiding members there are first guiding members provided with vertically spaced horizontal guiding track sections and second guiding members provided with two guiding cam track sections, said guiding cam track sections converging from both sides toward the middle of each of said second guiding members, crossing at said middle, and thereafter diverging, the first and second guiding members alternating in each array.

In the illustrative embodiment, the adjustment portions of the succession of guiding members on the first conveyor include a sliding element adapted for vertical reciprocation in a slot, such sliding element exhibiting three superposed cam track junctions which, when aligned with the fixed cam tracks on opposite sides of such adjustment member, serve to maintain or to switch the shed-forming position of the associated heddle elements.

The movement of the slider into one of the three operative positions of the adjustment portion is effected by the cooperation of a roller supported on the slider with an elongated slot of a link, which is carried for reciprocation in a programmed control portion of the loom located upstream of the weaving region. The slot includes a wide inlet region for receiving the roller in any of the slider positions, such slot converging in the downstream direction to a dimension just sufficient to slidably support the roller. A plurality of cam elements are supported on a driven endless program member in the control apparatus in the form of a second conveyor, such cam elements projecting by three radially different distances from the program member to engage a spring-loaded follower, which in turn is coupled to the vertically movable link in the path of the slider roller. The program member is moved in timed relation to the first conveyor, whereby the successive cam elements distributed along the program member periodically actuate the follower to position the link in a predetermined one of its three positions, corresponding in turn to one of the three junction positions of the adjustment portion of the succession of guiding members on the first conveyor.

Preferably, the slider is dove-tailed into its associated slot, and the longitudinally spaced edges of each of the adjacent the guiding members on the first conveyor are beveled to insure a smooth and uninterrupted entrance of the adjustment butts on the heddle holders into the superposed cam tracks.

Advantageously, a releasable detent mechanism is carried on the first conveyor for association with each slider to secure the slider in the adjusted position prior to its entrance into the weaving region. The detent is released during the adjustment of the slider position by the control portion of the apparatus.

As an additional safety measure, an alarm-indicating device may also be carried by the first conveyor for association with each slider, such mechanism being triggered into an operative position in the event that the slider moves out of its adjusted position in the region between the control portion of the loom and the entrance to the weaving region.

In order to further safeguard the apparatus against damage during changes in the control program, i.e., during changes of the cam elements on the program member, each of the reversing junctions on the slider element is provided with an auxiliary cam track path for interconnecting like tracks on the upstream and downstream sides of the adjustment portion.

BRIEF DESCRIPTION OF THE DRAWING

The invention is further set forth in the following detailed description taken in conjunction with the appended drawing, in which:

FIG. 1 is an overall elevation view of an arrangement in accordance with the invention for controlling shed formation in a travelling wave loom;

DETAILED DESCRIPTION

Figures 9, 10, 11, 12:
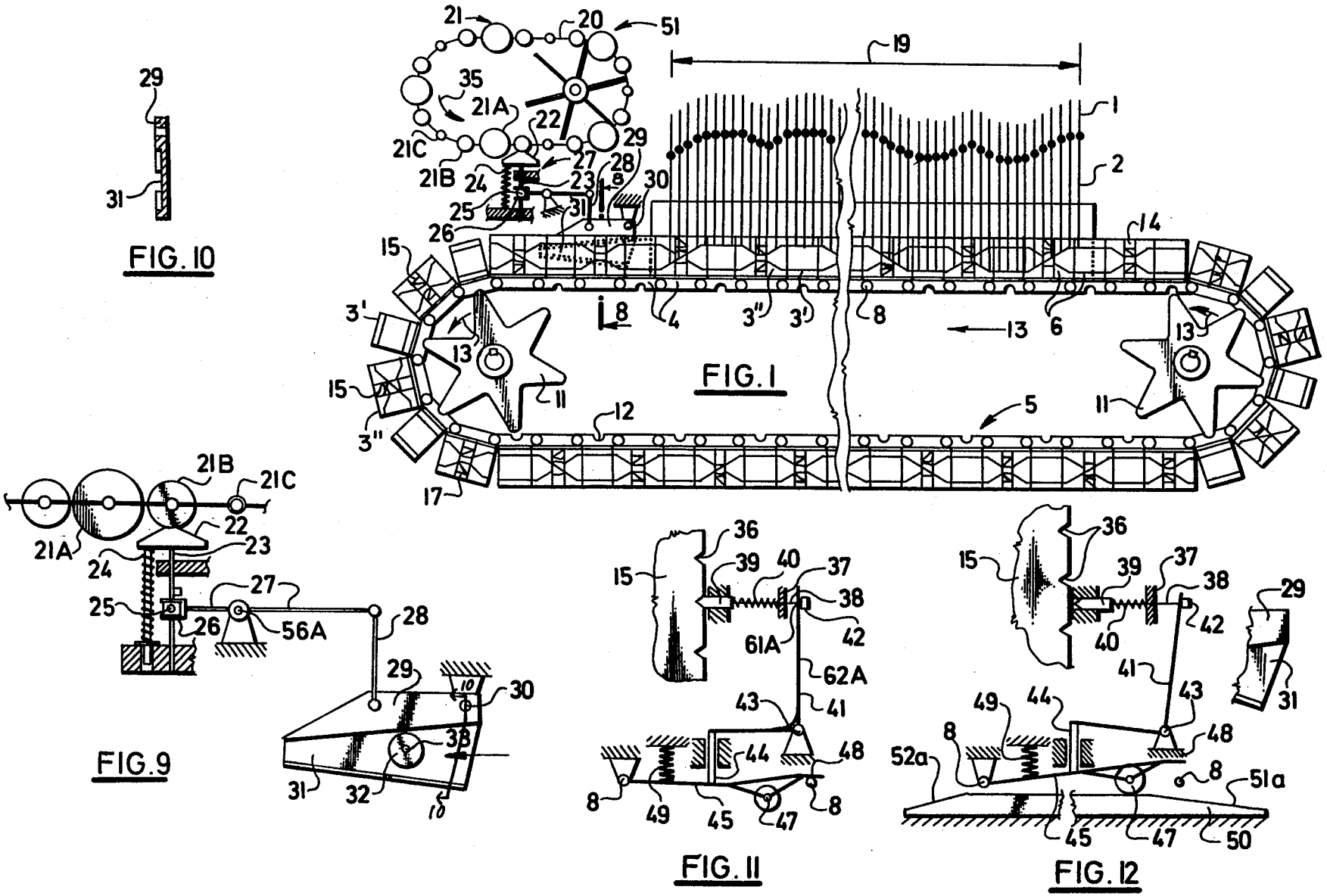
FIG. 9 is a representation elevation of the portion of the control section shown in FIG. 1, partially in schematic form.
FIG. 10 is a sectional view taken along line 10—10 of FIG. 9.
FIG. 11 is a fragmentary elevational view, partly in schematic form, of a releasable detent system associated with the conveyor of FIG. 1 for securing the slider in the adjusted position prior to entering the weaving region.
FIG. 12 is a fragmentary view similar to FIG. 11, but showing the detent in its released position.

Referring now to the drawing, FIG. 1 illustrates the weaving zone 19 of a traveling wave loom. A plurality of heddles 1 are disposed in axial relation along the zone 19, such heddles being mounted for reciprocation in associated ones of a plurality of heddle holders 2. In a conventional manner, the heddle holders 2 are positionable between an upper shed position and a lower shed position in accordance with a predetermined program, whereby sheds formed from a plurality of warp threads (not shown) engageable by the heddles 1 may be successively opened in wave-like passage to permit the insertion of a weft. Such shed-forming techniques are conventional in traveling wave looms, and will not be discussed further here.

The heddle holders 2 are positioned with the aid of cam sections 3', 3", which are disposed in alternating relation on a first endless conveyor 5.

Figure 2:
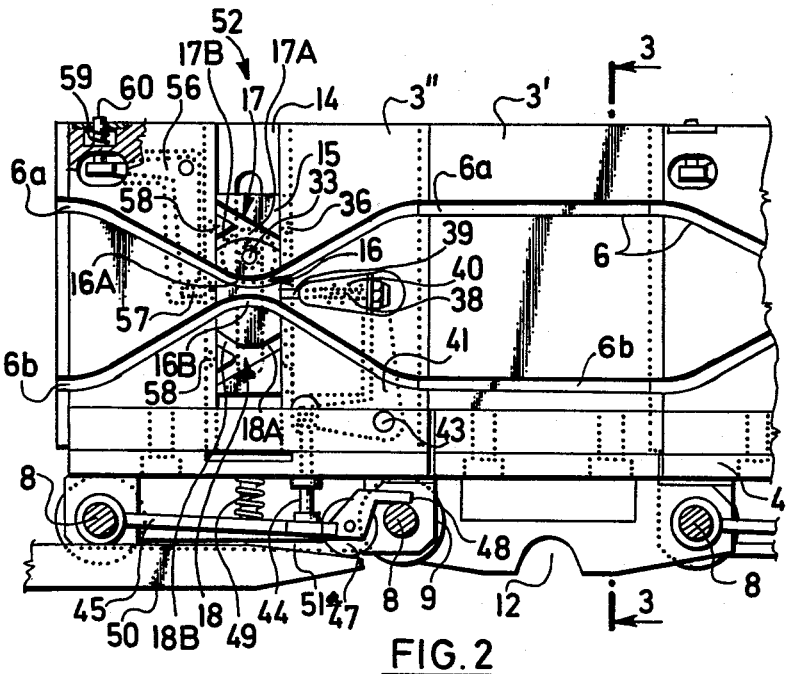
FIG. 2 is a detailed elevation view of a track switching portion of the apparatus of FIG. 1 associated with adjacent fixed and adjustable guiding members on an endless conveyor on which are disposed the upper and lower cam tracks for guiding the heddles of FIG. 1 into an upper and a lower shed-forming position, respectively.
Figure 4:
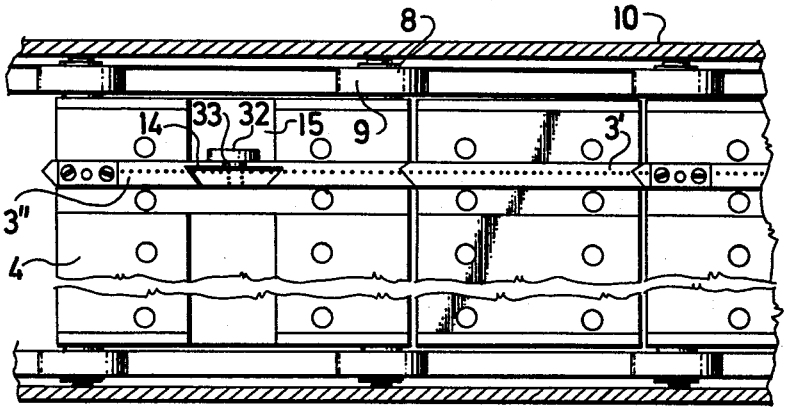
FIG. 4 is a plan view of the track-switching portion of the guiding members on the endless conveyor illustrated in FIG. 2.

As indicated in FIGS. 2 and 4, the alternating cam sections 3', 3", are carried on links 4 of the endless conveyor 5, with successive links being joined by bolts 8. Such bolts 8, in turn, carry rollers 9, on which the conveyor 5 can be moved along tracks 10 (FIG. 2) in an elongated path in the direction represented by arrow 13 (FIG. 1). The weaving zone 19 is disposed along a first straight portion of the path 13, so that the cam sections 3', 3" on the conveyor 5 can extend in successive relation through the zone 19 in a direction toward the left as viewed in FIG. 1.

The conveyor 5 is driven along the path 13 by a pair of sprockets 11, which cooperate with cutouts 12 on the successive links 4 in a conventional manner. Because of the endless nature of the path of the conveyor 5, cam sections exiting from the weaving zone 19 are adjusted in a control section 51, discussed below, and the so-adjusted cam sections are thereafter routed again into the weaving zone 19 to execute the next sequence of instructions of the program associated with the control section 51.

Figure 3:
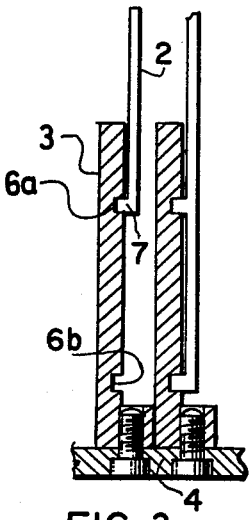
FIG. 3 is a sectional view taken along line 3—3 of FIG. 2.

Referring to FIG. 3, each of the heddle supports 2, is provided with a butt 7 which is selectively receivable in an upper fixed cam track 6*a* or a lower fixed cam track 6*b* in the cam sections 3', 3". The particular cam track to which the butt 7 is assigned during the pass of the conveyor 5 is controllable by means of an adjustable track-switching area 52 of each cam section 3".

The axially opposed boundaries of the section 52 communicate with diverging portions of the cam track 6*a*, which continue in fixed form in parallel relation on the next-adjacent cam section 3'. As a result, any heddle support 2 that is initially in the upper cam section 6*a* on the upstream side of the illustrated cam section 3" in FIG. 2 (i.e., in a direction to the left of the section 3" as viewed in FIG. 2) will initially converge toward the region 52 of the cam section 3". The butt 7 on each support 2, after passing through one of three positions described below in the description of the region 52, will emerge therefrom either in a corresponding upper track 6*a*, which thereafter diverges as shown in the figure to communicate with a straight portion of such upper track 6*a* in the next-adjacent cam section 3'. Alternatively, the butt 7 on each heddle support 2 in the upper cam track 6*a* upstream of the region 52 will emerge therefrom in the diverging lower cam track 6*b*, which subsequently joins with a straight portion of such track 6*b* in the adjacent cam section 3' as shown.

The so-described switching operation in the region 52 is effected, in accordance with the invention, with the use of a slider element 15 (FIGS. 5–7) which is supported for vertical reciprocation in a slot 14 of the cam section 3".

The slider 15 has disposed therein three superposed cam track connecting regions 16, 17 and 18, which can be individually aligned with the converging portions of the superposed cam tracks 6*a* and 6*b* on axially opposite sides of the slider 15.

Figure 5:
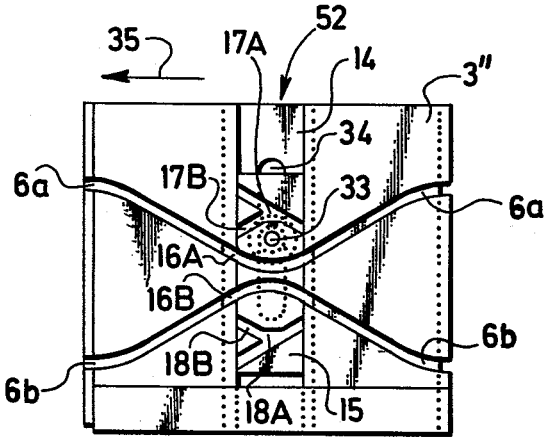
FIGS. 5–7 are detailed elevation views of a typical adjustment portion of the guiding members on the conveyor of FIG. 2, illustrating three separate positions of a track-adjusting slider.

For example, in the slider position shown in FIG. 5, the central cam track connecting region includes a pair of individual tracks 16A, 16B which operate to form continuations of and to effect communication between like cam tracks on opposite sides of the slider 15. Thus, the upper connecting region 16A joins the upper cam tracks 6*a* on opposite sides thereof, while the lower connection region 16B joins the lower cam tracks 6*b* on opposite sides thereof.

The slider position 15 shown in FIG. 5 represents a program instruction, effected by the control section 51, that the heddle supports 2 engaged by the cam section 3" in FIG. 5 are not to be changed from one extreme shed position to the opposite extreme shed position during the passage of the cam section 3″ through the weaving zone 19.

Figure 6:
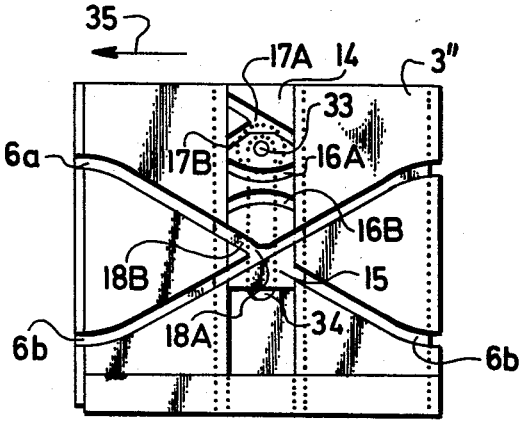

In the position of the slider 15 shown in FIG. 6, a portion 18A of the lower cam track connecting region 18 is positioned to interconnect the lower cam track 6*b* upstream of the section 52 with the upper cam track 6*a* downstream thereof. The transition of the slider 15 from the position shown in FIG. 5 to that shown in FIG. 6 is likewise dictated by the control section 51 as indicated below.

Figure 7:
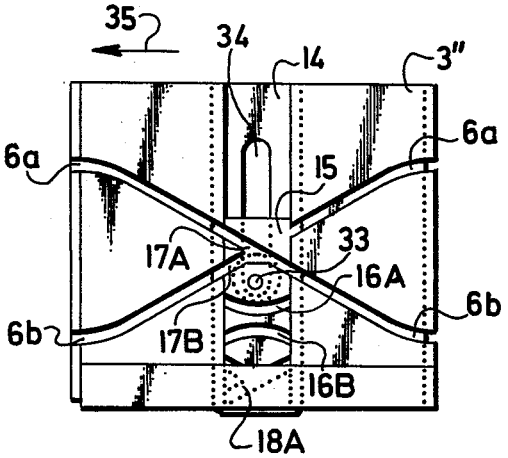

In FIG. 7, the slider 15 is so positioned that a region 17A of the upper cam track connecting region 17 interconnects the upper cam track 6*a* upstream of the section 52 with the lower cam track 6*b* downstream thereof. Again, the switching of the slider from one of the positions shown in FIGS. 5 and 6 to that shown in FIG. 7, and vice versa, is pre-determined by the program associated with the control section 51.

Figure 8:
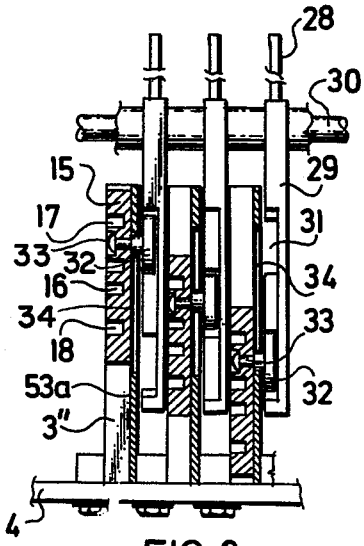
FIG. 8 is a sectional view taken along line 8—8 of FIG. 1, illustrating facilities for adjusting the position of each slider on the first conveyor of FIG. 1 in the case where the loom is provided with three heddle frames.

The view shown in FIG. 8 illustrates corresponding cam sections 3″ of each of three adjacent rows of heddles, all of which are carried by a link 14 of the endless conveyor 5 (FIG. 1). A boundary wall 53*a* of each cam section 3″, forming one side of the slider-receiving slot 14 (FIGS. 5 – 7), is provided with an elongated slot 34. A pivot pin 33 affixed to the associated slider 15 extends through the slot 34 to terminate in a roller 32, which is situated to enter an input end of an elongated slot 31 (FIG. 9) of a control link 29 as the associated cam section 3″ leaves the weaving zone 19 (FIG. 1) and enters an adjacent input region of the control section 51.

An inlet portion of the slot 31 (FIG. 9) of the link 29 is made sufficiently wide to receive the roller 32 irrespective of whether the slider is in the position shown in FIG. 5, 6 or 7. However, the slot 31 (FIG. 9) successively converges toward its output end, where it assumes a height just sufficient to permit of the roller 32. By raising or lowering the narrowed output end of the slot 31 by suitably pivoting the link 29 about a pin 30 (FIGS. 1 and 9), the roller 32 can either be maintained in the same horizontal position as it was when it entered the slot 31, or alternatively, such roller (and therefore its associated slider 15) can be cammed either upwardly or downwardly from the starting position so that a new orientation of the cam track connecting regions 16, 17 and 18 will result.

The positioning of the link 29, in turn, is regulated by a plurality of control rollers 21A, 21B, 21C carried on an endless program member 20 (FIG. 1) of the control section 51. Each roller 21A is larger in diameter than the roll 21B, and each roll 21B is larger in diameter than the roll 21C. The rolls 21 are distributed in accordance with a preselected program at spaced locations along the program 20, member which is advanced by suitable means (not shown) in a path represented by the arrow 35 in such a manner as to bring successive ones of the rolls 21 into impelling engagement with a follower or cam member 22, which is urged by a spring 24 (FIG. 9) against the periphery of the then-opposed one of the rolls 21.

The follower member 22 is affixed to a reciprocable rod 23, which carries a block 25 intermediate its ends. A left-hand arm of a two-arm lever 27, pivotally supported on a fulcrum 56*a*, terminates in a fork-shaped member 26 which engages the block 25 on the rod 23.

The right-hand arm of the lever 27 (FIG. 9) is affixed to an upper end of a pull rod 28, whose lower end is secured to a central portion of the control link 29. The diameters of the respective rolls 21A, 21B and 21C are chosen to respectively urge the left-hand end of the slot 31 of the link 29 into alignment with an associated one of the three positions of the slider 15 illustrated in FIGS. 5 – 7. Specifically, the largest diameter roll 21A will be effective to select the position shown in FIG. 6; the intermediate roller 21B will be effective to select the position shown in FIG. 5; and the smallest roller 21C will be effective to select a position shown in FIG. 7.

This can best be illustrated by referring to FIG. 1. Immediately prior to the situation depicted therein, the cam section 3″ which has just exited from the output end of the control link 29 has its slider 15 in the lowermost position, so that when such cam section has been moved around by the sprockets 11 to the input of the weaving zone 19, such cam section will be effective to move each heddle support 2 in the upper cam track 2 into the lower cam track 6*b*.

At the instant shown in FIG. 1, the intermediate roll 21B has just contacted the spring-loaded follower 22. Upon such contact, the downward movement of the block 25 on the rod 23 will pivot the lever 27 in a counterclockwise direction, thereby raising the left-hand end of the link 29 (which had just been in its lowermost position corresponding to the slider position on the cam section that had just left the link 29).

As a result, the cam section 3″ now entering the input end of the slot 31 of the link 29 will be adjusted into its intermediate position, so that when such cam section reaches the input of the weaving zone 19, the heddles 2 (which had been placed into their lowest shed position by the next-preceeding cam section 3″ as indicated above) will remain in such position because of the correspondence of the then-engaged intermediate roll 21*b* with the slider position illustrated in FIG. 5.

After such latter position has been selected and the program member 20 has been advanced by the next increment in the direction 35 (FIGS. 5–7), the largest-diameter roll 21A will engage the follower member 22. The larger displacement applied to the follower member 22 by such roll 21A will cause the lever 27 to pivot even further in the counterclockwise direction, thereby positioning the left-hand end of the control link 29 in its upper-most position corresponding to the slider position of FIG. 6. Thus, when the so-adjusted cam section 3″ moves around to the weaving zone 19, the successive heddle supports 2 (which had been left in the lower cam track 6*b* by the next-preceeding cam element 3″ as indicated above) will be shifted to the upper cam track 6*a* via the connecting section 18A in the slider 15.

In a similar manner, each of the succeeding rolls 21 on the program member 20 will be effective to adjust corresponding ones of the following cam section 3″ exiting from the weaving zone 19 into positons corresponding to the program represented by the distribution of such rolls. (For smooth operation of the heddle position selection process, each switching operation dictated by one of the rolls 21A and 21C, respectively, will be interrupted by a quiescent interval represented by an intermediate roll 21B.

Preferably, the longitudinal edges of the slider-receiving slot 14 (FIG. 4) in each cam section 3″ are of dove-tailed shape. The longitudinal edges of each of the abutting cam sections 3″ and 3′ have tongue and groove connections at their confronting ends to ensure smooth and uninterrupted entrance of the adjustment butts 7 on the heddle holder 2 into the superposed cam tracks. Such locally enlarged width, in turn, helps to more smoothly and easily effect the introduction of the butts 7 (FIG. 3) of the heddle support 2 into the selected cam slot. In order to secure each slider 15 in the selected one of the adjusted positions illustrated in FIGS. 5, 6 and 7, respectively, the arrangement indicated in FIG. 11 and 12 may be incorporated into the associated cam section 3". In particular, three superposed notches 36 are disposed in the downstream boundary of the slider 15, each of the notches 36 being individually centered at the location of one of the three cam track connecting regions 16, 17 and 18 of FIGS. 5 - 7.

A pawl member 39, which is arranged for reciprocation in the longitudinal direction of advance of the cam section 3", is normally urged in a direction away from a fixed abutment surface 37 on the cam surface 3" by means of a coil compression spring 40. The rear end of the pawl 39 is affixed to a rod 38, which extends through an aperture 61A near the outer end of a first arm 62A of a crank lever 41 to terminate in a shoulder 42. The crank lever 41 is pivotally mounted on a pin 43 affixed to the cam section 3". The outer end of the other arm of the lever 41 bears against the upper end of a pin 44, which is supported for reciprocation in the cam section 3".

The lower end of the pin 44 is affixed to an arm 45, whose left-hand end is secured to the bolt 8 on the associated conveyor link 4, and whose right end is normally urged downwardly against the next-succeeding bolt 8 in the downstream direction by means of a coil compression spring 49. A roller 47 is rotatably carried on the arm 45 for engagement with a doubly-inclined member 50, having on its inlet (i.e., right-hand) side an ascending surface 51*a* which is generally aligned with the input end of the control link 29. The output end of the member 50 has a descending surface 52*a*.

In the operation of the arrangement of FIGS. 11 and 12, the pawl 39 will normally hold the slider 15 immobilized in one of the positions selected by the control sections 51 until the associated cam section 3" has exited from the weaving zone 19 during its next pass therethrough. At this time, which corresponds to the entrance of the roller 32 carried by the slider 15 into the input end of the control link 29, the roller 47 will contact and start to climb up the ascending surface 51*a*(FIG. 12) of the member 50.

The resultant upward movement of the roller 47 will cause a corresponding upward movement of the pin 44, which in turn will impart a clockwise rotation to the crank lever 41. The resultant outward force applied by the upper end of the arm 62A of the lever 41 against the shoulder 42 will force the pawl 39 out of the associated notch 36 on the slider 15 against the force of the spring 40, thereby permitting the slider to be adjusted into one of the three positions illustrated in FIGS. 5 - 7 in the manner described above.

After such selection is made, which will cause either the same or one of the other two notches 36 to be positioned opposite the now-loaded pawl 39, the roller 47 will be moved down the descending surface 52*a* at the output end of the member 50, so that the pin 44 can again be urged downward by the spring 49. This, in turn, will permit the crank lever 41 to move in a counterclockwise direction from the position shown in FIG. 12 to that shown in FIG. 11. Thus, the upper end of the arm 62A will move away from the shoulder 42, and will permit the pawl 39 to engage the then-opposed notch 36 under the restoring force of the spring 40.

Figure 13:
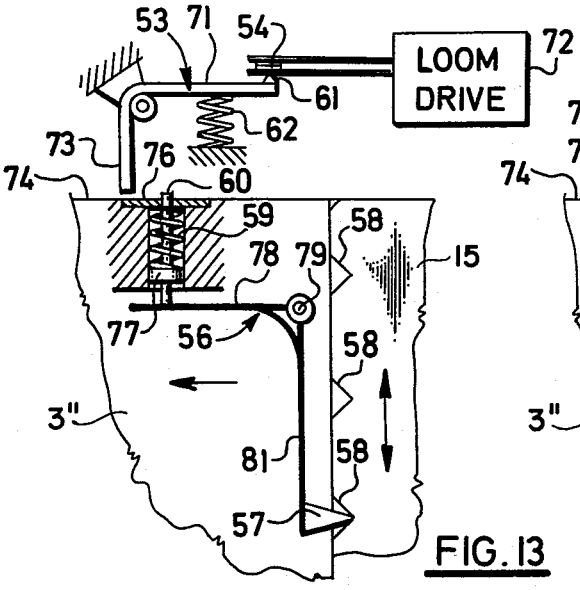
FIG. 13 is a fragmentary elevation view, partly in schematic form, of a detecting arrangement associated with the conveyor of FIG. 1 for disabling the loom when the slider inadvertently moves out of an adjusted position prior to entering the weaving region, the detecting portion being shown in its normal inoperative state.
Figure 14:
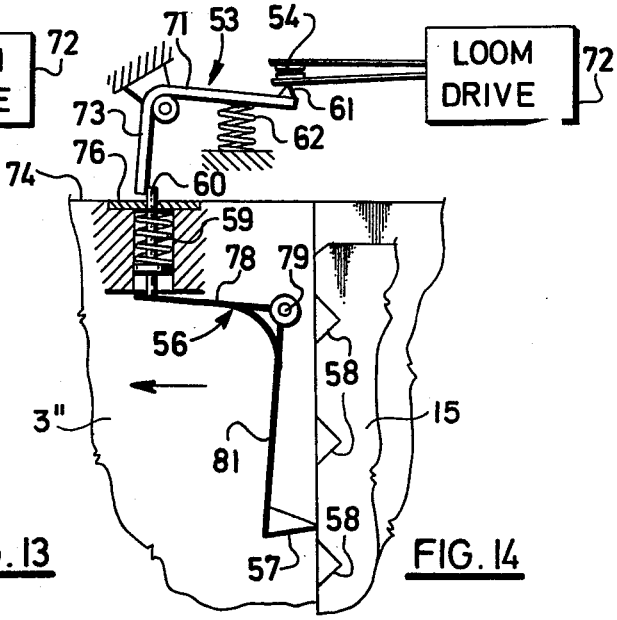
FIG. 14 is a fragmentary elevational view, similar to FIG. 13, but showing the operation of the detecting facilities in their operated position.

FIGS. 2 and 13 - 14 illustrate a detecting arrangement for yielding an alarm indication (illustratively a loom stopping signal) in the event that the slider 15 moves out of the selected one of its three pre-adjusted positions shown in FIGS. 5 - 7 before it reaches the weaving zone 19. For this purpose, a two-armed lever 53 is supported in the path of travel on the conveyor 5 between the control section 51 and the inlet end of the weaving zone 19. A first arm 71 of the lever 53 is biased by a coil compression coil compression spring 62 in a counterclockwise direction, so that an actuator 61 affixed to the outer end of the arm 71 will be effective to close a pair of contacts 54. The contacts 54, in turn, may be suitably associated with the excitation circuitry of the loom drive (represented at 72,) whereby the opening of the contacts 54 will be effective to deenergize the driving means for the loom.

The lever 53 has a lower arm 73 which terminates opposite and in spaced relation to a surface 74 of the cam section 3". The surface 74 has an insert plate 76 with an aperture for receiving an upwardly extending pin 60, which is urged inwardly by means of a coil compression spring 59. The lower end of the spring engages an abutment member 77, whose lower end rests on an upper arm 78 of a crank lever 56. The lever 56, which is supported for pivotal movement about a pin 79, has a lower arm 81 whose outer end is affixed to a pawl 57. Such pawl cooperates with one of three notches 58 disposed on the upstream boundary of the slider 15, each of the notches 58 being axially aligned with one of the three notches 36 (FIGS. 11-12) on the downstream surface of the slider 15. When the slider 15 is in a correctly adjusted position, the pawl 57 is in alignment with one of the three notches 58, and is maintained in such position by the downward force of the spring 59, acting through the abutment member 77 and the crank lever 56. In such position the pin 60, which is affixed to the upper portion of the abutment member 77, penetrates through the aperture in the insert plate 76 in the surface 74 for a distance less than that of the spacing between the surface 74 and the lower end of the arm 73 of the lever 53. Thus, the pin 60 will be clear of the lever 53 as the cam surface 3" moves past the detecting section.

On the other hand, if the slider 15 has moved or shifted into a position other than one of the position shown in FIGS. 5 - 7, the notches 58 will not line up with the pawl 57, leading to the situation shown in FIG. 14. In such case, the shift of the notches 58 will cam the pawl 57 in an outward direction so that it abuts the upstream boundary wall of the slider 15. Such movement will cause a clockwise movement of the crank lever 56, so that the outer end of the arm 78 thereof will move the pin 60 further outwardly through the aperture in insert 76. As a result, the pin 60 will contact the arm 73 of the lever 53, so that the lever 53 will be urged in a clockwise direction against the spring 62 to open the contacts 54. As a result, the loom drive 72 will be disabled.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In a travelling wave shedding loom, an apparatus for forming a travelling wave shed from warp threads threaded in heddles, the shed waves travelling one after the other across the loom, in the regions of maximum amplitude of said shed waves one part of the warp threads being in lower dead center position and the other part being in an upper dead center position, the apparatus comprising, in combination, at least two heddle rows arranged one after the other in the weaving region of the loom, the heddles in each row being arranged side-by-side;

heddle holders in each heddle row, said holders being movable independently of one another into lower and upper dead center position to form the shed wave;

an array of guiding members associated with each heddle row;

means for moving the guiding members in sequence across the loom;

a pair of superposed upper and lower guiding track sections provided in each guiding member, the respective upper and lower guiding track sections of all guiding members in each array forming together upper and lower tracks for controlling the strokes of the heddle holders to form a wave shed, the lower guiding track being adapted to guide the heddle holders into the lower dead center position and the upper guiding track being adapted to guide them into the upper dead center position;

in each array of guiding members there being first guiding members provided with vertically spaced horizontal guiding track sections and second guiding members provided with two guiding cam track sections, said guiding cam track sections converging from both sides towards the middle of each of said second guiding members, crossing at said middle, and thereafter diverging, the first and second guiding members alternating in each array;

butts provided on the heddle holders to engage the respective one of the guiding tracks;

vertically reciprocable sliders slidably mounted in the middle of said second guiding members, said sliders having three superposed systems of connecting tracks for three alternative modes of interconnecting the guiding cam track sections at both sides of the slider in the three operative positions of the slider;

means for selectively adjusting the slider according to a program into said three operative positions, in the first central operative position of which the upper guiding cam track sections as well as the lower guiding cam track sections at either side of the slider being interconnected, in the second operative position of the slider the upper guiding cam track section upstream of the slider being interconnected with the lower guiding cam track section downstream of the slider, and in the third operative position of the slider the lower guiding cam track section upstream of the slider being interconnected with the upper guiding cam track section downstream of the slider.

2. A loom as defined in claim 1, further comprising control means disposed upstream of the weaving region along the path of movement of the guiding members across the loom, the control means being cooperable with the slider of the successive adjustable portions of the guiding means for moving the slider of each such portion into one of first, second or third positions to respectively select one of the first, second and third operative positions of the slider.

3. A loom as defined in claim 2, in which each adjustable portion comprises a pivot pin projecting from the slider means, and first roller means rotatably supported on the pivot pin; and in which the control means comprises, in combination, a first link having a first slot extending therethrough and aligned with the first roller means of each slider means, the first slot having an inlet end sufficiently wide to receive the first roller means of the adjustable portion irrespective of the position of the associated slider means, the first slot converging toward its outlet end, and adjustable program means cooperable with the movement of the guiding members for discretely moving the first link into one of three positions in which the outlet end of the first slot is in registration with the first roller means when the associated slider is in its first, second and third positions, respectively.

4. A loom as defined in claim 3, further comprising releasable detent means disposed in the means for moving the guiding means in sequence across the loom and cooperable with each slider thereon for immobilizing the slider in a then-selected position, and means disposed upstream of the weaving region and rendered effective during a movement of the first link for releasing the detent means.

5. A loom as defined in claim 3, further comprising alarm-initiating means disposed on the first conveyor means intermediate the control means and the weaving region and cooperable with each slider for producing an output indication when the slider deviates from a selected one of its first, second and third positions.

6. A loom as defined in claim 3, in which the program means comprises, in combination, a conveyor means advanceable along a second path, a plurality of exchangeable cam elements projecting by a selectable one of first, second and third distances from the conveyor means at periodic intervals therealong, said distances corresponding respectively to the first, second and third positions of the first link, and follower means coupled to the first link and engageable with successive projections of the cam elements as the second conveyor means is advanced for setting the first link into a related one of such positions.

7. A loom as defined in claim 1, in which the first system of connecting tracks includes a first auxiliary cam track for associating the second system of connecting tracks upstream of the slider with the second system of connecting tracks of the slider.

8. A loom as defined in claim 7, in which the slider includes a second auxiliary can track for associating the first cam track upstream of the slider with the first track downstream of the slider.

* * * * *